252-99 AU 165 EX
9/28/76 XR 3,982,891

United States Patent [19]
Murray

[11] 3,982,891
[45] Sept. 28, 1976

[54] BLEACHING AND DETERGENT COMPOSITIONS HAVING IMIDE ACTIVATOR AND PEROXYGEN BLEACH

[75] Inventor: Leo Thomas Murray, East Brunswick, N.J.

[73] Assignee: Colgate-Palmolive Company, New York, N.Y.

[22] Filed: Sept. 18, 1975

[21] Appl. No.: 614,571

Related U.S. Application Data

[60] Division of Ser. No. 314,100, Dec. 11, 1972, Pat. No. 3,928,223, which is a continuation-in-part of Ser. No. 134,451, April 15, 1971, abandoned, which is a continuation-in-part of Ser. No. 677,747, Oct. 24, 1967, abandoned.

[52] U.S. Cl. ..... 8/111; 8/137; 252/95; 252/99; 252/102

[51] Int. Cl.[2] ..... D06L 3/02; C11D 3/395

[58] Field of Search ..... 252/186, 95, 99, 102; 8/111, 137; 423/582

[56] References Cited

UNITED STATES PATENTS

| | | | |
|---|---|---|---|
| 3,163,606 | 12/1964 | Viveen et al. | 252/99 |
| 3,583,924 | 6/1971 | Demangeon et al. | 252/102 |
| 3,637,339 | 1/1972 | Gray | 8/111 |
| 3,714,050 | 1/1973 | Gray | 8/111 |

*Primary Examiner*—Banjamin R. Padgett
*Assistant Examiner*—Irwin Gluck
*Attorney, Agent, or Firm*—Norman Blumenkopf; Murray M. Grill; Herbert S. Sylvester

[57] ABSTRACT

Activator compounds for bleaching and/or detergent compositions comprising imides having an N-bonded grouping of the formula — COOR wherein R represents lower alkyl or phenyl typical compounds including e.g., N-methoxycarbonylphthalimide; N-methoxycarbonylsaccharide, N-phenoxycarbonyl succinimide, and N-methoxycarbonyl acetamide.

15 Claims, No Drawings

BLEACHING AND DETERGENT COMPOSITIONS HAVING IMIDE ACTIVATOR AND PEROXYGEN BLEACH

This is a divisional of application Ser. No. 314,100, filed Dec. 11, 1972 now U.S. Pat. No. 3,928,223, which is a continuation-in-part of application Ser. No. 134,451 filed April 15, 1971, now abandoned which, in turn, is a continuation-in-part of application Ser. No. 677,747 filed Oct. 24, 1967, and now abandoned.

The present invention relates, in general, to compositions advantageously adapted for use in connection with fabric washing, bleaching operations and the like and, in particular, to the provision of specific compounds and compositions for such purposes, said compositions characterized in being capable of providing an exceptionally high order of bleaching activity.

The utilization of bleaching agents as an adjunct to fabric washing operations is, of course, a well established practice and, in many instances, a recognized necessity. Thus, many of the detergent formulations currently available commercially include pre-determined quantities of bleaching agent as an essential ingredient; specific representatives of bleaching agents found to be suitable in this regard are well known in the art being extensively described in the published literature both patent and otherwise and include, for example, the chlorine bleaches, e.g., the alkali metal hypochlorites; active oxygen releasing compounds, e.g., peroxides (peroxygen compounds) such as perborate, percarbonates, perphosphates, persilicates, persulfates, hydrogen peroxide, sodium peroxide and the like.

The peroxide type bleaching agents are, in general, preferred for use vis-a-vis the more strongly acting bleaches, being found to be markedly superior as regards capability of providing a fabric having a softer hand, improved absorbency, permanency of whiteness and the like. In contradistinction, stronger bleaches characteristically yield fabrics having a pronounced tendency to develop spurious discoloration upon aging, i.e., "yellowing". Moreover, fabrics so treated invariably exhibit significant loss in strength and thus the frequency of bleaching may be such as to severely curtain the useful life of the fabric material.

Despite the cumulative advantages inherent in the use of bleaching agents of the active oxygen releasing type, such materials present in the rather serious disadvantage that maximum realization of their beneficial properties can only be obtained ordinarily with the use of elevated temperature ranges, i.e., temperatures in excess of about 85°C. In fact, experience establishes that temperature values of 90°C. and even higher are mandatory with peroxide bleaches in order to achieve the requisite degree of bleaching activity. The rather critical temperature-dependency of the peroxide bleaching agents and especially the persalt bleaches such as sodium perborate poses a rather serious drawback in view of the extensive public use of washing machines at temperatures ranging from about 50° to about 60°C., well below those necessary to render bleaching agents such as the perborates adequately effective for even normal household purposes. Consequently, washing operations requiring a comparatively high order of bleaching activity at reduced temperature ranges invariably necessitate resort to the use of bleaching agents other than those of the peroxide type despite the attendant disadvantage necessarily involved, i.e., with respect to possible impairment of fabric strength, inferior resistance to discoloration, etc.

In order to capitalize on the advantageous features characterizing peroxide type bleaching agents in general and those of the perborate type in particular, considerable industrial activity has centered around the research and development of means whereby to increase the effectiveness of such materials at reduced temperatures and particularly within the range of from about 50°C. to 60°C. and lower and thus to correspondingly extend their area of effective use.

Perhaps paramount among the techniques thus far promulgated for such purposes are those involving the use of the peroxide bleaching agent in conjunction with one or more auxiliary agents, the latter functioning as activators serving to promote or otherwise augment the bleaching capacity of the peroxide material and thus to make possible the obtention of optimum bleaching activity within the lower temperature ranges.

Although the precise mechanism by which activator compounds of this type function is not self-evident, it has nevertheless been postulated by way of general hypothesis that activator-peroxide interaction leads to the formation of intermediate species which in themselves behave as active bleaching agents. In a sense, then, the activator-peroxide components function as a precursor system by which the in situ generation of species providing effective bleaching means is made possible.

Although remedial techniques of the foregoing nature have proved effective and perhaps meritorious in some instances, it has nevertheless been found in practice that the activator compounds thus far suggested in the art for such use are subject to one or more disadvantages. Perhaps the primary objections relate to the failure to provide the desired degree of bleaching activity within the limitations imposed by economically feasible practice. Thus, it is often necessary to utilize the activator compound in inordinately high concentrations in order to achieve satisfactory results; in other instances it is found that a given activator is not generally applicable and thus may be used advantageously only in conjunction with rather specific and delimited types of peroxide bleaching agents. Other disadvantages characterizing many of the activator compounds thus far provided include, for example, the difficulties associated with their incorporation into detergent powder compositions. Since many of the activators are liquids under normal conditions, the blending of such materials into solid products proves highly problematical. Moreover, ancillary techniques specifically devised for purposes of facilitating activator-detergent powder blending in such instances are often economically prohibitive, the results obtained failing to justify the increase in cost involved.

Thus, a primary object of the present invention resides in the provision of activator compounds specifically and advantageously adapted for conjoint use with peroxide compounds in bleaching and/or detergent compositions wherein one or more of the disadvantages characterizing many of the compounds heretofore suggest for such purposes are eliminated or, at least, alleviated to a substantial degree.

A further object of the present invention resides in the provision of activator compounds capable of augmenting the bleaching capacity of peroxide compounds to the extent that such materials are rendered feasible for use at temperatures below about 85°C.

Another object of the present invention resides in the provision of activator compounds as well as bleaching and detergent compositions containing same, capable of yielding fabric materials having satisfactory absorbency, softness of hand, resistance to discoloration upon standing or aging, etc.

Other objects and advantages of the present invention will become more apparent hereinafter as the description proceeds.

The attainment of the foregoing and related objects is made possible in accordance with the present invention which in its broader aspects includes the provision of activator compounds for use in conjunction with active oxygen-releasing bleaching agents, said activator compounds comprising water soluble imides selected from the group consisting of mono-imides and polyimides, said imide compound containing at least one N-bonded substituent of the formula — COOR wherein R represents lower alkyl of from 1 - 4 carbon atoms, e.g., methyl, ethyl, propyl, butyl or phenyl. The terms phenyl and alkyl as used herein are intended to encompass substituted forms thereof with the obvious limitation that the nature of any such substituent group be such as not to deleteriously affect the properties desired in the ultimate compound e.g., solubility, reactivity, with the bleaching agent, etc. Thus substituents such as halo e.g., chloro; alkyl e.g., methyl, ethyl, propyl, isopropyl, n-butyl, isobutyl; sulfonylallyl, e.g., $-SO_2CH_3$, $-SO_2C_2H_5$; cyano; hydroxyalkyl; hydroxyalkoxyalkyl, are permitted.

The imide compounds suitable for use in accordance with the present invention may be either cyclic or acylic in nature and thus encompass a relatively broad range of material. For convenience, however, the N-alkoxy and N-phenoxy-carbonyl imides contemplated herein may be represented according to the following structural formula:

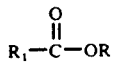

wherein R has the above defined significance and $R_1$ represents a straight chain or cyclic imide radical, the moiety

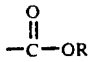

being bonded directly to an imide nitrogen atom present in the concatenation of atoms comprising said imide radical. The straight chain (i.e., non-cyclic) imides may be further represented by the general formula

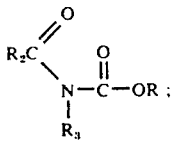

wherein $R_2$ is $C_1$ to $C_{20}$ alkyl or substituted alkyl (i.e., haloalkyl, cyanoalkyl, alkoxyalkyl (total 40 C atoms), etc.; R is as defined above; and $R_3$ is similar to $R_2$ or may be —COOR. Particularly beneficial results as regards capacity to enhance the effective bleaching activity of the active oxygen releasing compound have been noted to obtain with the cyclic imide compounds and, in particular, those containing from 5-6 intracyclic atoms, i.e., the pentatomic and hexatomic ring species. Specific representatives of compounds of this type include, for example, hydantoin and glutarimide species. Further examples of cyclic imides which may be employed to advantage for the purposes described herein, include those of the condensed or fused ring type, e.g., the aformentioned phthalimide derivatives. Thus, the cyclic imide compounds may for convenience be represented according to the following structural formula:

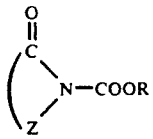

wherein R has the aforedescribed significance and Z represents the non-metallic atoms necessary to complete a cyclic imide selected from the group consisting of condensed and non-condensed ring systems. It will be understood that the foregoing formula is intended to encompass cyclic imides containing more than one N-bonded — COOr substituent. Compounds of this type are permitted in those instances wherein the cyclic imide compound contains more than one intracyclic nitrogen atom. Similarly, with reference to imide compounds of the aliphatic (e.g., straight chain) type, polysubstituted derivatives are readily obtained in those instances wherein more than one nitrogen atom is present. Alternatively, a given nitrogen atom may contain two — COOR groups, either or both forms of substitution being found to provide compounds capable of effective bleach activation.

Examples of useful classes of cyclic compounds are substituted and unsubstituted imides containing at least one N-bonded substituent of the formula COOR wherein R is defined as above, such as:

Succinimides

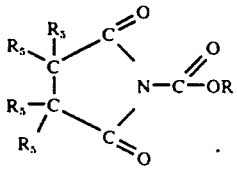

;

Phthalimides

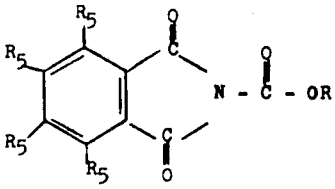

;

Saccharides

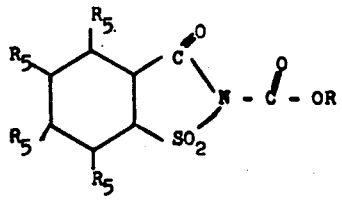

;

and

Hydantoin

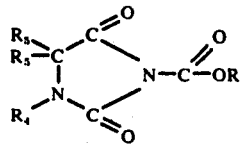

wherein $R_4$ is hydrogen, —COOR or lower alkyl or alkoxy of 1–4 carbon atoms, or phenyl, and $R_5$ is hydrogen, halogen, or lower alkyl or alkoxy of 1–4 carbon atoms.

As particular examples of compounds falling within the ambit of the above depicted structural formula, there may be mentioned in particular and without necessary limitation the following:

N-methoxycarbonyl saccharide
N-methoxycarbonyl phthalimide
N-ethoxycarbonyl phthalimide
N-methoxycarbonyl succinimide
N-methoxycarbonyl 5,5-dimethylhydantoin
N-phenoxycarbonyl succinimide
N,N-di(methoxycarbonyl) acetamide
N-methoxycarbonyl glutarimide
N-isopropoxycarbonyl phthalimide
butoxycarbonyl phthalimide
N-butoxycarbonyl succinimide
N-p-toluoxycarbonyl phthalimide
N-methoxycarbonyl butyramide
N-methoxycarbonyl stearamide The water soluble imide compounds of the present invention may also contain more than one N-bonded ester group. As specific examples of compounds of this type, there may be mentioned the following:

1, 3-di-(N-methoxycarbonyl)-hydantoin
1, 3-di-(N-methoxycarbonyl-5,5-dimethyl hydantoin The imide activators described herein are singularly characterized in that they permit the highly effective use of peroxide bleaching agents at temperatures considerably below those heretofore permitted with such compounds. This, of course, provides the salient advantage that the beneficial properties uniquely typical of the more mildly acting peroxide bleaches are made available at temperature ranges conventionally employed in home laundering operations. In addition, bleaching and detergent compositions containing the novel imide activators described herein exhibit negligible tendency to weaken or otherwise detract from the strength of the fabric or textile material treated therewith, the term "textile" being used herein to connote natural and synthetic fibers as well as products manufactured therefrom or therewith. This particular factor is of primary importance since it bears directly upon the useful life of the fabric material. Thus, the compositions of the present invention are devoid of any tendency to deleteriously affect cellulose as well as synthetic fibers such as polyamide. In addition, such compositions exhibit little if any tendency to attack the coloring material present in the fabric; similarly, such compositions yield fabrics having excellent resistance to discoloration while sustaining a relatively high degree of whiteness over extended periods of time and usage. Such faborable characteristics redound to signficant advantage in connection with the washing and/or bleaching of cotton goods as well as other fabrics customarily employed in the manufacture of personal wearing apparel. A further advantage relates to the fact that the imide activators described herein in combination with perborate bleaching agents in particular affords to the user great latitude in pre-determining and thus controlling bleaching action or activity. This may be readily achieved in view of the comparatively mild bleaching action of the perborates. Thus, any possibility of overbleaching is minimized if not completely eliminated.

The activator compounds of the present invention may in general, be readily and conveniently prepared by reacting the parent imide molecule, preferably provided in the form of the salt derivative, i.e., sodium salt, silver salt, potassium salt, etc., with an alkylchloro formate, preferably in solvent media, the reaction being carried out under reflux conditions. Product isolation and recovery can thereafter be affected by recrystallization, filtering and washing.

The imide activators described herein can be effectively employed either singly or in admixtures comprising two or more. Again, the efficacy of a given manner of proceeding depends primarily upon the existing requirements, i.e., the specific problem to be negotiated by the bleach composition. In any event, optimum combinations of imide activators can be readily determined in a particular circumstance by routine laboratory investigation. The utilization of such compounds in admixtures presents the advantage that the beneficial properties of a plurality of imides can be combined in a single bleaching and/or detergent composition. The relative proportions of bleaching agent and imide activator employed may vary over a relatively wide range depending somewhat upon the nature of the composition being formulated. In general, beneficial results are readily obtained by the use of the imide activator in effective amounts sufficient to yield an amide/peroxide mole ratio within the range of from about 0.01 to about 2.0, with a range of from 0.1 to 2.0 being preferred. Thus, in the case of a simple bleach composition, the involved ingredients will comprise, essentially, the imide activator and peroxide. When formulating detergent compositions, the peroxide compound will usually be utilized in amounts sufficient to yield a concentration within the range of from about 1% to about 50%, weight basis, of total composition, with other ingredients including detergent, brightener, perfume, etc. It will be understood that the aforementioned limits are not critical per se but serve only to define those values found to yield optimum results for the broad spectrum of operations to which such compositions may be applied. Thus, minor proportions of imide activator will nevertheless be found adequate to provide the desired degree of bleach activity. The imide activators described herein can likewise be employed to outstanding advantage in combination with one or more of the conventional activator compounds currently available commercially. Again, the choice of particular systems as well as concentrations lies largely within the descretion of the manufacturer. In any event, it is preferred that the imide compound be used in major proportions in those instances wherein activator mixtures are employed.

A further embodiment of the present invention contemplates the use of the imide activator in coated form i.e., covered with a solid material soluble in the washing and/or bleaching solution. Coating materials suitable for such use are well known in the art including, for example, a wide variety of polymeric materials such as polyethylene glycols, condensation products of ethylene oxide, propylene oxide, etc., polyvinyl alcohol, carboxymethylcellulose, cetyl alcohol, fatty acid alkanolamides, etc. It is preferred practice to granulate the activator compounds prior to coating with the aforementioned polymer materials. The provision of the bleach activator in coated form presents the additional advantage that the shelf life is enhanced significantly and especially in those instances wherein the product composition is provided in powder form. The coating of the activator granules can be readily accomplished according to any of the customary methods described in the art for such purposes. Thus, the coating material may be dissolved in water or organic solvent and thereafter spray-applied to the activator compound provided in finely divided form and thereafter dried.

The imide activator and peroxide bleaching agent may be formulated together in a built detergent composition or alternatively as a separate bleach product. When provided in the latter form, the activator and bleach may be either intimately mixed or included in separate compartments of a water soluble film packet.

The following examples are given for purposes of illustration only and are not to be considered as necessarily constituting a limitation on the present invention. Illustrative imide activator materials are prepared in the following manner.

A. Preparation of N-methoxycarbonyl saccharide

A suspension comprising 25 millimoles of sodium saccharide and 20 ml of methylchloroformate is heated under reflux for approximately 6½ hours. After cooling, insolubles are removed from the reaction medim by filtering. Thereafter, the insolubles are treated with hot acetone and the resulting insoluble portion (sodium chloride) discarded. The acetone solution is cooled whereupon the desired product crystallizes, m.p. 204°–205°C.

Anal. Calcd. for $C_9H_7O_5$ NS: C—44.81, H—2.93, N—5.81. Found: C—44.83, H—3.18, N—6.07.

B. Preparation of N-methoxycarbonyl phthalimide

A suspension comprising 25 millimoles of potassium phthalimide and 20 ml of methylchloroformate is refluxed for a period of approximately 3½ hours. Upon completion of refluxing, the reaction mediuim is cooled, filtered, with insolubles being removed continuously by treatment with hot acteone until only potassium chloride remains. The desired product m.p. 184°–184.5°C., is obtained from the acetone.

Anal. Calcd. for $C_{10}H_7O_4$ N: C—58.54, H—3.44, N—6.83. Found: C—58.83, H—3.55, N—7.00.

C. Preparation of N-ethoxycarbonyl phthalimide

A suspension comprisng 25 millimoles of potassium phthalimide and 20 ml ethylchloroformate is refluxed for approximately 3½ hours. Insolubles are removed by hot acetone treatment in the manner described in preparation B. Upon completion of the acetone treatment and removal of mother liquor the product is combined and recrystallized from ethanol. Further recrystallizaton from a mixture of ethylchloroformate and ether yields a white product having a melting point of 89.5°–90.5°C.

D. Preparation of 3-methoxycarbonyl - 5,5-dimethylhydantoin

The silver salt of 5,5-dimethylhydantoin is prepared by reacting hydantoin and an equivalent of sodium hydroxide with silver nitrate. The silver thus formed is then reacted directly with excess methylchloroformate under reflux conditions for a period of 4–6 hours. After cooling, the precipitated solids formed are filtered and washed with acetone with silver chloride being discarded. The foregoing synthesis is repeated except that the silver salt methylchloroformate reaction is carried out in the presence of benzene and excess methylchloroformate. Similar results are obtained. Alternatively, the 3-methoxycarbonyl - 5,5-dimethylhydantoin may be prepared in the following manner. 5,5-dimethylhydantoin in potassium hydroxide solution is reacted with methylchloroformate in ether, there being obtained crude product and unreacted hydantoin. The crude product is recrystallized from benzene and then twice from n-butanol. The product thus obtained has a melting point ranging from 115°–124°C. Further purification of a small sample yields a white solid having a melting point of 120.5° – 122.5°C. Anal. Calcd. for $C_7H_{10}O_4N_2$: C—45.16, H—5.42, N—15.05. Found: C—45.41, H—5.76, N—14.94.

E. Preparation of N-methoxycarbonyl succinimide

Sodium succinimide, prepared by reacting sodium hydride and succinimide in toluene solvent under reflux is reacted with methylchloroformate, the latter employed in excess, in benzene solvent. An orange-red oil is obtained. Recrystallization from an ether-alcohol-acetone solvent mixture yields pale yellow crystals having a melting point of 50.5° – 52.0°C. The product is confirmed by infra-red analysis. Anal. Calcd. for $C_6H_7O_4N$: C—45.86, H—4.49, N—8.91. Found: C—46.05, H—4.86, N—8.93.

Repeating the aforedescribed procedure in the absence of benzene solvent for the sodium succinimide-methylchloroformate reaction yields similar results.

F. Preparation of N-phenoxycarbonyl succinimide

To 50 millimolses of phenylchloroformate in 25 ml of ether are added 16.7 ml of a 3M potassium hydroxide solution containing 50 millimoles of predissolved succinimide. The system is then stirred for about 1 hour, additional ether added and then restirred for about 1 hour. The insolubles formed are removed by filtering. Thereafter, the crude product is recrystallized from butanol saturated with water to give the desired product, melting point 132° – 133.5°C.

Anal. Calcd. for $C_{11}H_9NO_4$: C—60.27, H—4.14, N—6.39. Found: C—60.05, H—3.95, N—6.25.

In a manner analogous to Preparation A there are also prepared, substituting for the 20 ml of methylchloroformate an equivalent amount of the indicated chloroformate, the following saccarides:

| Chloroformate | Saccharide |
|---|---|
| 1. ethyl chloroformate | N-ethoxycarbonylsaccharide |
| 2. isobutyl chloroformate | N-isobutoxycarbonylsaccharide |
| 3. phenyl chloroformate | N-phenoxycarbonylsaccharide |
| 4. p-tolyl chloroformate | N-p-toluoxycarbonylsaccharide |
| 5. p-ethylphenyl chloroformate | N-p-ethylphenoxycarbonylsaccharide |
| 6. p-cyanophenyl chloroformate | N-p-cyanophenoxycarbonylsaccharide |
| 7. phenylethyl chloroformate | N-phenethoxycarbonylsaccharide |

Each of the imide activator compounds A-F prepared in the aforedescribed manner is evaluated in a wash procedure comprising the following sequence of operations. A series of washing compositions is prepared in tergotometer buckets by dissolving in 1,000 ml of water 2.0 grams of a detergent of the following composition:

21% tridecyl benzene sulfonate sodium salt
26.4% sodium sulfate
35% phosphates
tripolyphosphate, sodium
tri-sodium-ortho-phosphate
pyrophosphate, sodium
7% sodium silicate
0.4% carboxymethylcellulose, sodium with the remainder comprising antioxidant, perfume, etc.

To each of the tergotometer buckets is added two millimoles each of sodium perborate and imide activator specified so as to yield a concentration of $2 \times 10^{-3}$M. Control samples are similarly prepared but omitting the activator. The wash samples comprise grape-stained cotton swatches. All washes are conducted at a temperature of 120°F. for 10 minutes followed by rinsing and air drying. The average reflectance unit reading (Rd) is determined both before and after washing: and the difference between such measurements, represented in the table by Δ Rd, for each of the systems set forth. The results obtained are itemized in the following table:

TABLE

| Ex. No. | Activator | ΔRd |
|---|---|---|
| 1 (a) | Perborate alone | 44.8 |
| (b) | N-methoxycarbonyl saccharide + perborate | 52.2 |
| (c) | N-methoxycarbonyl phthalimide + perborate | 48.5 |
| 2 (a) | Perborate alone | 42.6 |
| (b) | N-ethoxy carbonyl phthalimide + perborate | 44.4 |
| (c) | 3-methoxycarbonyl-5,5-dimethylhydantoin + perborate | 52.3 |
| 3 (a) | Perborate alone | 37.8 |
| (b) | N-phenoxycarbonyl succinimide + perborate | 50.5 |
| 4 (a) | N-methoxycarbonyl saccharide + perborate | 48.5 |
| (b) | 3-methoxycarbonyl-5,5-dimethylhydantoin + perborate | 48.4 |
| 5 (a) | N-methoxycarbonyl succinimide + perborate | 50.3 |
| (b) | N-phenoxycarbonyl succinimide + perborate | 53.1 |

The disparity in ΔRd values for the various control samples as well as corresponding differences in ΔRd for common bleach systems is due primarily to the conditions of testing. Thus, the saturation and color density of the stain varied due to slight differences in period of immersion of the swatch sample in the stain media, receptivity, absorptivity of the cotton swatch for the stain media, etc. However, each of the samples comprising a given test set possessed approximately equal initial stain densities thereby providing a valid basis for comparison.

As the above data makes manifestly clear, the significant increase in ΔRd for those cotton samples treated with the imide activator-perborate system indicates that a highly efficient and active bleaching function obtains when compared to those samples which had been subjected to the action of the perborate alone, i.e., absent the activator additive. As will be appreciated, the reflectance for a given material is a direct function of its level of whiteness; thus, greater differences in reflectance readings taken before and after subjection to the bleaching operation indicate correspondingly higher bleaching activity.

As mentioned hereinbefore, the compositions containing the imide activators described herein can be provided in the form of a bleaching composition or alternatively in the form of a built detergent product. Organic detergents suitable for use in accordance with the present invention encompass relatively wide range of materials and may be of the anionic, nonionic, cationic or amphoteric types.

The anionic surface active agents include those surface active or detergent compounds which contain an organic hydrophobic group and an anionic solubilizing group. Typical examples of anionic solubilizing groups are sulfonate, sulfate, carboxylate, phosphonate and phosphate. Examples of suitable anionic detergents which fall within the scope of the invention include the soaps, such as the water-soluble salts of higher fatty acids or resin acids, such as may be derived from fats, oils, and waxes of animal, vegetable or marine origin, e.g., the sodium soaps of tallow, grease, coconut oil, tall oil and mixtures thereof; and the sulfated and sulfonated synthetic detergents, particularly those having about 8 to 26, and preferably about 12 to 22, carbon atoms to the molecule.

As examples of suitable synthetic anionic detergents there may be cited the higher alkyl mononuclear aromatic sulfonates such as the higher alkyl benzene sulfonates containing from 10 to 16 carbon atoms in the alkyl group in a straight or branched chain, e.g., the sodium salts of decyl, undecyl, dodecyl, (lauryl), tridecyl, tetradecyl, pentadecyl, or hexadecyl benzene sulfonate and the higher alkyl toluene, xylene and phenol sulfonates; alkyl naphthalene sulfonate, ammonium diamyl naphthalene sulfonate, and sodium dinonyl naphthalene sulfonate.

Other anionic detergents are the olefin sulfonates, including long chain alkene sulfonates, long chain hydroxyalkane sulfonates or mixtures of alkensulfonates and hydroxyalkanesulfonates. These olefin sulfonate detergents may be prepared, in known manner, by the reaction of $SO_3$ with long chain olefins (of 8–25, preferably 12–21 carbon atoms) of the formula RCH—CHR$_1$, where R is alkyl and R$_1$ is alkyl or hydrogen, to produce a mixture of sultones and alkensulfonic acids, which mixture is then treated to convert the sultones to sulfonates. Examples of other sulfate or sulfonate detergents are paraffin sulfonates, such as the reaction products of alpha olefins and bisulfites (e.g., sodium bisulfite), e.g., primary paraffin sulfonates of about 10–20, preferably about 15–20, carbon atoms: sulfates of higher alcohols; salts of α-sulfotatty esters (e.g., of about 10 to 20 carbon atoms, such as methyl α-sulfomyristate of α-sulfotallowate).

Examples of sulfates of higher alcohols are sodium lauryl sulfate, sodium tallow alcohol sulfate. Turkey Red Oil or other sulfated oils, or sulfates of mono- or diglycerides of fatty acids (e.g., stearic monoglyceride monosulfate), alkyl poly (ethanoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly (ethanoxy) ether sulfates such as the sulfates of the condensation products of ethylene oxide and nonyl phenol (usually having 1 to 20 oxyethylene groups per molecule preferably 2–12).

The suitable anionic detergents include also the acyl sarcosinates (e.g., sodium lauroylsarcosinate) the acyl esters (e.g., oleic acid ester) of isethionates, and the acyl N-methyl taurides (e.g., potassium N-methyl lauroyl- or oleyl tauride).

The most highly preferred water soluble anionic detergent compounds are the ammonium and substituted ammonium (such as mono-, di and triethanolamine), alkali metal (such as sodium and potassium) and alkaline earth metal (such as calcium and magnesium) salts of the higher benzene sulfonates, olefin sulfonates, the higher alkyl sulfates, and the higher fatty acid monoglyceride sulfates. The particular salt will be suitably selected depending upon the particular formulation and the proportions therein.

Nonionic surface active agents include those surface active or detergent compounds which contain an organic hydrophobic group and a hydrophilic group which is a reaction product of a solubilizing group such as carboxylate, hydroxyl, amido or amino with ethylene oxide or with the polyhydration product thereof, polyethylene glycol.

As examples of nonionic surface active agents which may be used there may be noted the condensation products of alkyl phenols with ethylene oxide, e.g., the reaction product of isooctyl phenol with about 6 to 30 ethylene oxide units; condensation products of alkyl thiophenols with 10 to 15 ethylene oxide units; condensation products of higher fatty alcohols such as tridecyl alcohol with ethylene oxide; ethylene oxide addends of monoesters of hexahydric alcohols and inner ethers thereof such as sorbitan monolaurate, sorbital monooleate and mannitan monopalmitate, and the condensation products of polypropylene glycol with ethylene oxide.

Cationic surface active agents may also be employed. Such agents are those surface active detergent compounds which contain an organic hydrophobic group and a cationic solubilizing group. Typical cationic solubilizng groups are amine and as quaternary groups.

As examples of suitable synthetic cationic detergents there may be noted the diamines such as those of the type $RNHC_2H_4NH_2$ wherein R is an alkyl group of about 12 to 22 carbon atoms, such as N-2-aminoethyl stearyl amine and N-2-aminoethyl myristyl amine; amide-linked amines such as those of the type $R^1CONHC_2H_4NH_2$ wherein $R^1$ is an alkyl group of about 9 to 20 carbon atoms, such as N-2-amino ethylstearyl amide and N-amino ethyl myristyl amide; quaternary ammonium compounds wherein typically one of the groups linked to the nitrogen atom is an alkyl group of about 12 to 18 carbon atoms and three of the groups linked to the nitrogen atom are alkyl groups which contain 1 to 3 carbon atoms, including such 1 to 3 carbon alkyl groups bearing inert substituents, such as phenyl groups, and there is presend an anion such as halogen, acetate, methosulfate, etc. Typical quaternary ammonium detergents are ethyl-dimethyl-stearyl ammonium chloride, benzyl-dimethyl-stearyl ammonium chloride, benzyl-dimethyl-stearyl ammonium chloride, trimethyl stearyl ammonium chloride, trimethyl-cetyl ammonium bromide, dimethyl-ethyl dilauryl ammonium chloride, dimethyl-propyl-myristyl ammonium chloride, and the corresponding methosulfates and acetates.

Examples of suitable amphoteric detergents are those containing both an anionic and cationic group and a hydrophobic organic group, which is advantageously a higher aliphatic radical, e.g., of 10-20 carbon atoms. Among these are the N-long chain alkyl aminocarboxylic acids (e.g. of the formula $$R-\overset{\overset{\displaystyle R_2}{|}}{N}-R'-COOM);$$

the N-long chain alkyl iminodicarboxylic acids (e.g., of the formula $RN(R'COOM)_2$) and the N-long chain alkyl betaines (e.g., of the formula $$R-\underset{\underset{\displaystyle R_4}{|}}{\overset{\overset{\displaystyle R_3}{|}}{N}}-R'-COO^-)$$

where R is a long chain alkyl group, e.g., of about 10–20 carbons, R′ is a divalent radical joining the amino and carboxyl portions of an amino acid (e.g., an alkylene radical of 1–4 carbon atoms), M is hydrogen or a salt-forming metal, $R^2$ is a hydrogen or another monovalent substituent (e.g., methyl or other lower alkyl), and $R^3$ and $R^4$ are monovalent substituents joined to the nitrogen by carbon-to-nitrogen bonds (e.g., methyl or other lower alkyl substituents). Examples of specific amphoteric detergents are N-alkyl-beta-aminopropionic acid; N-alkyl-beta-iminodipropionic acid, and N-alkyl, N,N-dimethyl glycine; the alkyl group may be, for example, that derived from coco fatty alcohol, lauryl alcohol, myristyl alcohol (of a lauryl-myristyl mixture), hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents a long chain fatty imidazolines such as those made by reacting a long chain fatty acid (e.g., of 10 to 20 carbon atoms) with diethylene triamine and monohalocarboxylic acids having 2 to 6 carbon atoms, e.g., 1-coco-5-hydroxyethyl-5-carboxymethylimidazoline; betaines in which the long chain substituent is joined to the carboxylic group without an intervening nitrogen atom, e.g., inner salts of 2-trimethylamino fatty acids such as 2-trimethylaminolauric acid, and compounds of any of the previously mentioned types but in which the nitrogen atom is replaced by phosphorus.

Where employed the detergent may comprise from 1 to 99% by weight of the total composition with the balance the peroxide and activator combination. A preferred detergent range is 1 to 50% by weight and most usually preferred is 2 to 50 % by weight.

The detergent composition may further contain one or more water-soluble builder salts which may be either organic or inorganic in nature. Suitable representatives include the following:

Trisodium phosphate
Tetrasodium pyrophosphate
Sodium acid pyrophosphate
Sodium tripolyphosphate
Sodium monobasic phosphate
Sodium dibasic phosphate
Sodium hexamethaphosphate Sodium metasilicate
Sodium silicates, $Na_2O/SiO_2$ of 1/1.6 to 1/3.2
Sodium carbonate
Sodium sulfate
Borax
Ethylene diamine tetraacetic acid tetrasodium salts
Trisodium nitrilotriacetate
Citrates, e.g., sodium citrate, citric acid
Glycollates, e.g., sodium glycollate
Phosphorates
Diphosphorates
Organic polyelectrolytes, e.g., vinyl methyl ether -maleic anhydride interpolymers and water-soluble salts thereof (alkali metal, ammonium, amine, etc.); polymaleic anhydride and water-soluble salts (sodium, potassium, ammonium, etc.)

Mixtures of two or more inorganic or organic salts can be used, as can mixtures of inorganic and organic salts.

Particularly preferred herein are water-soluble, alkali metal polyphosphate builder salts. These salts form water-soluble complexes with calcium and magnesiuim ions found in hard water and thereby prevent the formation of insoluble salts which tend to deposit upon textiles during a washing cycle. Further, such phosphates enhance the detersive efficiency of anionic detergents, aid in controlling sudsing powers and aid in keeping soil suspended in the washing bath after its removal from the soiled textiles.

Various other materials may be included in compositions of the invention, whether in solid or liquid form, by addition in known manner to the aqueous mixtures or to the solidified product. Examples thereof are the higher fatty acid amides such as coconut or lauric monoethanolamide, isopropanolamide and the like; hydrotropic solubilizing agents such as xylene or toluene sulfonates; organic solubilizing agents such as ethanol, ethylene glycol and hexylene glycol; sodium carboxymethyl-cellulose and polyvinyl alcohol antiredeposition agents; optical and fluorescent brightener materials; coloring agents; corrosion inhibiting agents; germicides, perfumes, bluing agents; and the like.

Preferred compositions advantageously contain a hydrophobic colloidal cellulosic soil-suspending agent which is soluble or dispersible in water also. The joint use of the combination of the cellulosic compound and polyvinyl alcohol is particularly effective for soil-suspension properties during the washing of a variety of fabrics, including both cotton and synthetic fibers such as nylon, Dacron and resin-treated cottons. The mixtures are used preferably in a total amount of 0.1 to 2 percent by weight of the solids. Preferred cellulosic compounds are the alkali metal salts of a carboxy lower alkyl cellulose having up to 3 carbons in the alkyl group, such as the sodium and potassium salt of carboxymethylcellulose. Suitable salts are sodium carboxyethylcellulose; the cellulose sulfates and lower alkul and hydroxyalkylcellulose ethers such as methyl-, ethyl-, and hydroxyethylcellulose.

The proportions of such ingredients are not particularly critical and may be selected so as to conform with established practice. In any event, the detergent agent is usually employed in concentrations ranging from about 2% to about 50% by weight of the composition. The builder salts, whether organic or inorganic, are preferably employed in concentrations ranging from about 10% to about 95% by weight of the composition.

Other ingredients of a conventional nature include perfume and chelating agents. A typical representative of the bleach formulations encompassed by the foregoing definition would include, for example, the following:

| | | |
|---|---|---|
| Sodium carbonate | 5 | parts |
| Sodium tripolyphosphate | 30 | parts |
| 3-methoxycarbonyl-5,5-dimethyl-hydantoin | 26.6 | parts |
| Sodium perborate | 22 | parts |
| Sodium tridecylbenzenesulfonate | 2 | parts |

with the remainder comprising on a 100 parts basis, sodium sulfate, brightener, perfume, chelating agent, etc. It is to be fully understood that the above formulation is given solely for purposes of illustration; thus departures from the specific concentration values given may be dictated in a particular circumstance depending upon the requirements of the processor.

Typical built detergent formulations are as follows:

| | | |
|---|---|---|
| A. | Sodium tridecylbenzene sulfonate | 10 parts |
| | Sodium tripolyphosphate | 30 parts |
| | 3-methoxycarboxyl-5,5-dimethyl hydantoin | 5 parts |
| | Sodium perborate | 20 parts |
| | Sodium carbonate | 10 parts |
| | Sodium silicate ($SiO_2/Na_2O = 2.5$) | 10 parts |
| | Sodium sulfate | 12 parts |
| | Brightener, CMC, perfume Q.S. to 100 parts total | |
| B. | Sodium tridecylbenzene sulfonate | 15 parts |
| | Sodium carbonate | 20 parts |
| | Sodium silicate ($SiO_2/Na_2O = 2.6$) | 15 parts |
| | Sodium perborate | 25 parts |
| | N-methoxycarbonyl phthalimide | 10 parts |
| | Sodium sulfate | 12 parts |
| | Brightener, CMC, polyvinyl alcohol, perfume Q.S. to 100 parts total | |

Results similar to those obtained in the foregoing examples are obtained when the procedure described therein are repeated but employing in lieu of sodium perborate equivalent amounts of one or more of the other peroxide bleaching agents described hereinbefore such as sodium percarbonate, sodium persilicate, etc.

The terminology "water-soluble peroxide", "persalt" bleaching agent as used herein is intended to connote those compounds which give rise to hydrogen peroxide when dissolved in water. Thus, the peroxide compounds hereinbefore described as being suitable in the practice of the present invention are believed to contain hydrogen peroxide of crystallization.

The bleaching compositions of the present invention may be effectively employed over a relatively wide range of pH values in the absence of appreciable risk of damage to the fabric material being treated. The desired pH may be readily achieved by the addition of suitable buffering agents to the bleaching solution or alternatively by including the buffering agent as an ingredient of the bleaching composition in the dry state. Since the bleaching compositions described herein are effective at relatively high pH values, they may be readily used in combination with common household laundry soaps and detergents for preventive bleaching of fiber materials. For the vast majority of bleach and/or washing applications, a pH within the range of from about 6 to 10 is recommended.

The present invention has been described with respect to certain preferred embodiments thereof and there will become obvious to persons skilled in the art other variations, modifications and equivalents which are to be understood as coming within the scope of the present invention.

I claim:

1. A bleaching composition consisting essentially of a water soluble peroxygen bleaching compound selected from the group consisting of perborates, percarbonates, persulfates, persilicates, perphosphates, hydrogen peroxide and sodium peroxide; and a water soluble imide having the formula $R_1$—COOR wherein R represents a $C_1$ to $C_4$ alkyl or phenyl and $R_1$ represents an acyclic imide radical, an imide nitrogen atom of which is bonded directly to the depicted —COOR moiety, the mol ratio of imide to peroxygen compound ranging from 0.01 to 2.0.

2. The composition of claim 1 wherein $R_1$ comprises an acetamide radical.

3. The composition of claim 2 wherein said imide is N,N-di(methoxycarbonyl) acetamide.

4. The composition of claim 1 wherein said imide has the formula

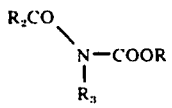

wherein R represents a $C_1$ to $C_4$ alkyl or phenyl; $R_2$ represents $C_{1-20}$ alkyl, $C_{1-20}$ haloalkyl, $C_{1-20}$ cyanoalkyl, or $C_{2-40}$ alkoxyalkyl; and $R_3$ has the values of $R_2$ or is COOR.

5. The composition of claim 4 wherein $R_2$ is $CH_3$.

6. The composition of claim 5 wherein $R_3$ is COOR.

7. The composition of claim 6 wherein R is $CH_3$.

8. The composition of claim 4 wherein $R_2$ is propyl.

9. The composition of claim 4 wherein $R_2$ is heptadecyl.

10. The composition of claim 1 wherein said peroxygen compound is sodium perborate.

11. The composition of claim 1 wherein said peroxygen compound is sodium percarbonate.

12. A detergent composition consisting essentially of a detergent selected from the group consisting of anionic, nonionic, cationic and amphoteric detergents and a bleaching composition as defined in claim 1.

13. A detergent composition as defined in claim 12 wherein the amount of peroxygen bleaching compound ranges from 2 to 50% by weight.

14. A process for bleaching textile materials which comprises contacting said material with an aqueous solution of a bleaching composition as defined in claim 1.

15. A process for laundering textile materials which comprises contacting said materials with an aqueous solution of a detergent composition as defined in claim 12.

* * * * *